US006845902B1

(12) United States Patent
Bömer et al.

(10) Patent No.: US 6,845,902 B1
(45) Date of Patent: Jan. 25, 2005

(54) FLAT GABLE COMPOSITE PACKING PROVIDED WITH A RESEALABLE SPOUT AND PROCEDURE FOR ITS MANUFACTURE

(75) Inventors: Hans Bömer, Erkrath (DE); Matthias Dammers, Alsdorf (DE); Christoph Mehler, Mönehengladbach (DE); Hans Weiteder, Emmendingen (DE)

(73) Assignee: SIG Combibloc Systems GmbH, Linnich (DE)

( * ) Notice: Subject to any disclaimer, the term of this patent is extended or adjusted under 35 U.S.C. 154(b) by 3 days.

(21) Appl. No.: 10/089,387

(22) PCT Filed: Sep. 29, 2000

(86) PCT No.: PCT/EP00/09572

§ 371 (c)(1),
(2), (4) Date: Jan. 23, 2003

(87) PCT Pub. No.: WO01/25098

PCT Pub. Date: Apr. 12, 2001

(30) Foreign Application Priority Data

Oct. 1, 1999 (DE) ..... 199 47 296

(51) Int. Cl.[7] ..... B65D 5/74

(52) U.S. Cl. ..... 229/125.09; 229/125.14; 229/125.15; 220/258.3; 220/258.4; 220/258.5; 220/278

(58) Field of Search ..... 220/258.3, 268.4, 220/258.5, 278; 229/123.3, 125.15, 125.09, 123.4, 125.64, 125.14, 125.17

(56) References Cited

U.S. PATENT DOCUMENTS

| | | | | | |
|---|---|---|---|---|---|
| 3,768,719 | A | * | 10/1973 | Johnson | 229/117.3 |
| 4,781,323 | A | * | 11/1988 | Elias et al. | 229/123.3 |
| 4,930,683 | A | | 6/1990 | Färber | |
| 4,949,882 | A | * | 8/1990 | Take | 222/528 |
| 5,067,614 | A | * | 11/1991 | Jonsson | 229/123.1 |
| 5,199,635 | A | | 4/1993 | Abrams et al. | |
| 5,348,184 | A | * | 9/1994 | Adams et al. | 220/266 |
| 5,397,013 | A | * | 3/1995 | Adams et al. | 220/255.1 |

FOREIGN PATENT DOCUMENTS

| | | |
|---|---|---|
| DE | 4409945 | 9/1995 |
| EP | 755862 | 1/1997 |
| FR | 2770832 | 5/1999 |

* cited by examiner

*Primary Examiner*—Tri M. Mai
(74) *Attorney, Agent, or Firm*—Proskauer Rose LLP

(57) ABSTRACT

Proposed for a square flat gable composite packing are a resealable spout element (1) and the manufacture of a flat gable composite packing with such a spout element (1) that eliminate the disadvantage of known spout elements, namely that such packings can no longer be opened once the sealed-on opening aids for initially opening the packing lose their non-positive bond with the packing during transport or as the result of inadequate proposed, with a cap (2), in which an opening element (4) sealing. A resealable spout element (1) is attached to the packing interior can be bonded with the cap (2) to form an undetachable unit by means of a connecting element (5) that penetrates an opening surface present in the packing.

25 Claims, 3 Drawing Sheets

FLAT GABLE COMPOSITE PACKING PROVIDED WITH A RESEALABLE SPOUT AND PROCEDURE FOR ITS MANUFACTURE

BACKGROUND OF THE INVENTION

The invention relates to a flat gable composite packing, in particular a square lug packing, wherein the composite has at least one carrier layer made out of paper or cardboard, a coupling agent layer, an oxygen barrier layer, preferably made out of aluminum, and a bilateral plastic coating made out of polyethylene (PE), with a casting opening provided in the packing gable, and with a resealable spout element, which has a flange and a cap connected thereto, whose flange enveloping the casting opening is rigidly bonded with the packing surface, as well as a procedure for manufacturing such a flat gable composite packing.

The casting opening is normally a covered casting opening provided in the packing gable, or a casting opening stamped out in the area of the packing gable.

Flat gable composite packings are known in numerous designs. They are primarily used in the area of liquids packaging in conjunction with cold, cold-sterile, hot and aseptic filling. These packings are partially provided with spout elements sealed onto the gables, which are designed to be resealable with a cap. For opening such packings for the first time, it is known to provide an opening element sealed onto the composite piece, which forms an opening surface that generates a casting opening after opened.

In the flat gable composite packing known from DE 44 09 945 A1, it was proposed that a notch circling the opening surface be provided, and that an opening aid be non-positively secured inside the notch for withdrawing the composite pieces forming the opening surface and enveloped by the notch. However, the flat gable composite packing described above needs improvement in several areas. On the one hand, the is conceivable that the non-positive connection of the opening aid and composite piece most often designed as a seal might become weakened or even broken by stresses during the transport of the packing. As a result, it would no longer be possible to open the described packing with the opening aid.

In addition, the described packing provides that the composite material forming the opening surface be completely removed by means of the opening aid. This results in a throwaway part already during the first step of opening the flat gable composite packing that must be separately disposed of.

SUMMARY OF THE INVENTION

Proceeding from the above, the object of the present invention is to design and develop further a flat gable composite packing of the kind described at the preamble, along with a procedure for its manufacture, in such a way as to enable a reliable opening of the packing.

In terms of the flat gable composite packing, the object is achieved by virtue of the fact that, in a flat gable composite packing according to the present invention, an opening element attached to the packing interior can be bonded with the cap to form an undetachable unit by means of a connecting element that penetrates the coated casting opening.

In a flat gable composite packing with a casting opening stamped out in the area of the packing gable the object is achieved by virtue of the fact that a sealing element attached to the packing interior can be bonded by means of a connecting element with the cap to form an undetachable unit in the area of the casting opening, that the sealing element has a larger surface than the casting opening, a weakening line that corresponds to the contour of the casting opening and borders an opening element, and is provided with a product-side gas or aroma barrier layer, and that the opening element is separated out from the sealing element by the opening of the spout element.

In terms of the process for manufacturing such a flat gable composite packing, the object is achieved via the following steps:

- Manufacturing the casting opening in the carrier layer,
- Coating the casting opening with the outer PE layer, the oxygen barrier layer and the inner PE layer,
- Molding on the packing floor,
- Puncturing the film layers covering the casting openings with the connecting element,
- Connecting the opening element with the inner PE layer,
- Securing the spout element and connecting the cap with the opening element by means of the connecting element, and
- Folding and sealing the packing gable after filling.

In this flat gable composite packing with a casting opening stamped out in the area of the packing gable, the object concerning the manufacturing procedure is achieved via the following steps:

- Coating the carrier layer with the outer PE layer, the oxygen barrier layer and inner PE layer,
- Manufacturing the casting opening in the area of the packing gable,
- Molding on the packing floor,
- Securing the spout element and seating element, and connecting the cap with the opening element by means of the connecting element, and
- Folding and sealing the packing gable after filling.

The invention ensures a reliable opening of the flat gable composite packing. When the cap is opened the first time, the opening element lying below the casting opening relative to the cap is pulled out of the packing. While doing so, it frees the casting opening, thereby forming the casting hole. If the flat gable composite packing is designed with a covered casting opening, the opening element takes the film layers covering the casting opening with it while being pulled out of the packing. If the flat gable composite packing is designed with a casting opening stamped out in the area of the packing gable, the opening element that seals the casting opening from the packing interior opens the casting opening.

As opposed to prior art, the film layers covering the casting opening are no longer removed via a potentially erroneous, non-positive connection with the opening element by actuating the opening element, but rather the films coated over the casting opening are either taken out of the packing from below along with the opening element pulled out of the packing when the cap opens, or, given a casting opening sealed by the opening element, the casting opening is freed on initial opening.

The fact that the opening element is connected with the inner PE film additionally ensures that the opening surface weakened by the penetration of connecting elements is sealed to satisfy the hygiene requirements.

In order to remove the film layers entrained by the opening element during initial opening over as large a surface as possible, it makes sense for the contour of the opening element to preferably correspond to the contour of the casting opening. To open the covered casting opening, it here makes sense in particular if the opening element is sharp-edged on its edges pointing toward the inner PE layer. In addition, this design ensures that the edges of the PE film enveloping the formed casting hole are uniformly separated, so that the flat gable composite packing according to the invention places the focus on user wishes relating not just to hygiene, but to aesthetics as well.

As an alternative, it is possible to design the opening element to be enveloped by a weakening line in a sealing element, whose surface is greater than that of the casting opening, wherein the surface of the opening element corresponds to that of the stamped-out casting opening. In such a design of the opening element., the opening element breaks out of the sealing element along the weakening line during initial opening, and is pulled out of the packing. The remainder of the sealing element remains as a ring enveloping the casting opening in the packing.

The manufacture of the resealable spout element is simplified by virtue of the fact that the connecting element is molded onto the opening element as a single piece. However, it is also possible to mold the connecting element to the cap as a single piece. It is also advantageous for the cap to have a recess to receive the end of the connecting element facing the cap. This design simplifies the bonding of the connecting element with the cap.

It has proven advantageous for reliably opening the casting opening with the opening element if the recess provided in the cap is arranged closer to the actuating side of the cap than to the site where the cap is hinged to the spout element. As a result of this design, the forces introduced into the film layers by the opening element given a covered casting opening are greater than it the recess were to be located in the middle of the cap. When the flat gable composite packing is designed with a stamped out casting opening sealed by the opening element, this arrangement of the connecting element enables a better detachment of the opening element from the sealing element.

It has proven to be particularly beneficial to design the connecting element as a pin or web. This makes it easier to puncture the film layers covering the casting opening with the connecting element, and connect the opening element with the cap by means of the connecting element, as described in the procedure according to the invention.

The connecting element is connected in a particularly effective manner with the cap if its free end is designed as a barb for the form-fitting connection of the opening element with the opening cover. This design allows the connecting element to positively latch with the cap while applying the spout element.

As an alternative or in addition, the connecting element can be positively or non-positively bonded with the cap via thermal treatment, to achieve a particularly reliable bond between the connecting element and the cap.

The connecting element can be easily introduced into the recess of the cap in particular when slit in a plane perpendicular to the sealed cover. As a result, the connecting element can be compressed on its end facing the cap, and hence be more easily introduced into the recess of the cap, in particular in the embodiment with a cross-section designed as a barb.

The user is given special protection by providing an "originality seal" between the flange and cap of the spout element, which is broken when the cap is initially opened.

BRIEF DESCRIPTION OF THE DRAWINGS

The invention will be described in greater detail below based on a drawing that depicts only an embodiment. The drawing shows.

DETAILED DESCRIPTION OF THE INVENTION

Figure 1:
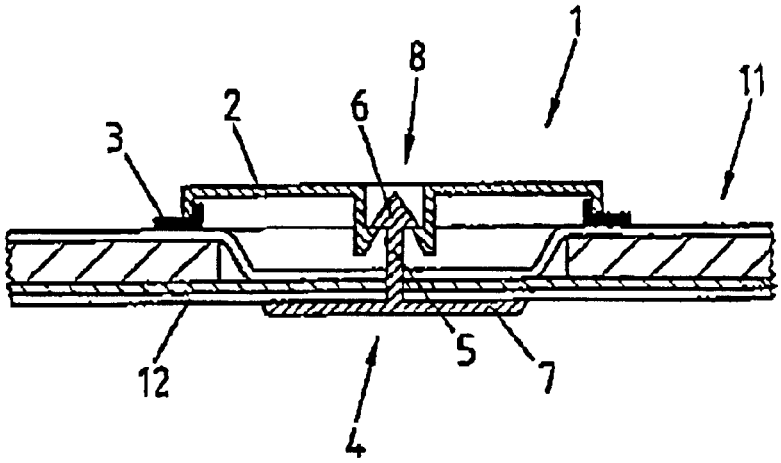
FIG. 1 a cross section through a spout element according to the invention.

FIG. 1 shows a spout element 1 with a cap 2, a flange 3 and an opening element 4. The opening element 4 has a connecting element 5, whose end 6 facing the cap 2 has a head designed like a barb. The connecting element 5 is connected with a place 7 of the opening element 4 attached to the packing interior. The cap 2 has a recess 8 for receiving the barb-shaped end 6 of the connecting element 5.

Figure 2:
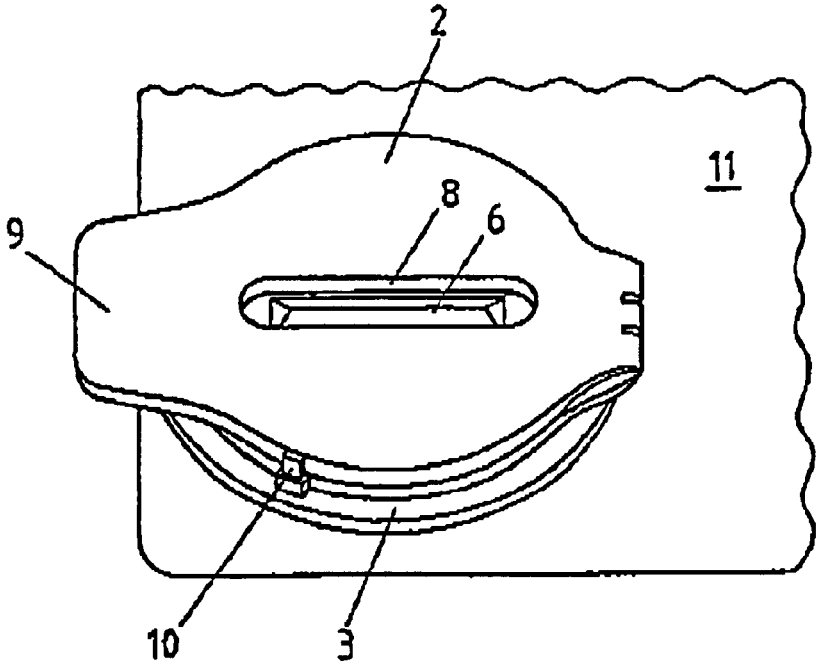
FIG. 2 a perspective depiction of the still unopened spout element according to FIG. 1, FIG. 3 a perspective depiction of the opened spout element according to FIG. 1, FIG. 4A a first embodiment of the opening element, FIG. 4B a second embodiment of the opening element, FIG. 4C a third embodiment of the opening element, and FIG. 5 a cross section through a spout element according to the invention with an opening element according to FIG. 4C.

As evident from FIG. 2, the cap 2 also has an actuating element 9, with which the cap 2 can be opened. As shown, the cap 2 is preferably bonded with the flange 3 of the spout element 1 by means of an originality seal 10. The spout element 1 is connected with the flat gable composite packing 11 by means of its flange 3.

When the cap 2 is first opened with the actuating element 9, the positive bond of the barb-shaped end 6 with the cap 2 pulls the plate 7 of the opening element 4 from the connecting element 5 and out of the flat gable packing 11. In this opening process, the plate 7 of the opening element 4 penetrates the film layers 12 covering the casting opening. In addition, the originality seal 10 is broken during initial opening of the flat gable composite packing, wherein one portion 10A remains on the cap 2, and a second portion 10B remains on the flange 3 of the casting spout element 1.

Figure 3:
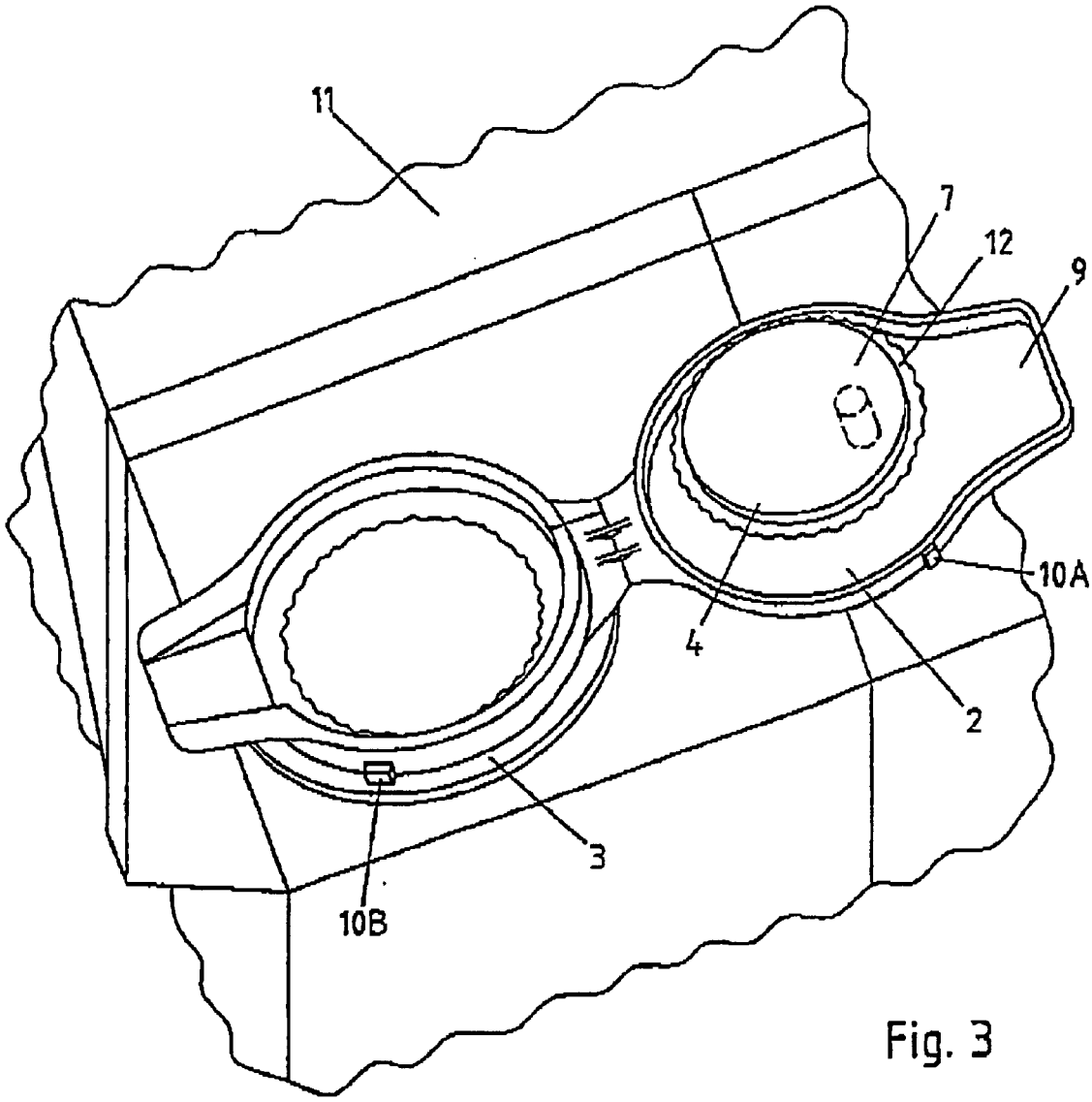

FIG. 3 shows the spout element when opened. This is depicted by the opening motion of the cap 2 from the opening element 4 pulled out of the packing. The entrained film layers 12 remain adhesively on the plate 7 of the opening element, held by the connecting element 5, and the preferably adhesive bond between the opening element 4 and the film layers 12. In addition, the broken originality seal 10 is shown with its residual half 10A remaining on the cap 2, and its residual half 10B remaining on the flange 3.

Figure 4A:
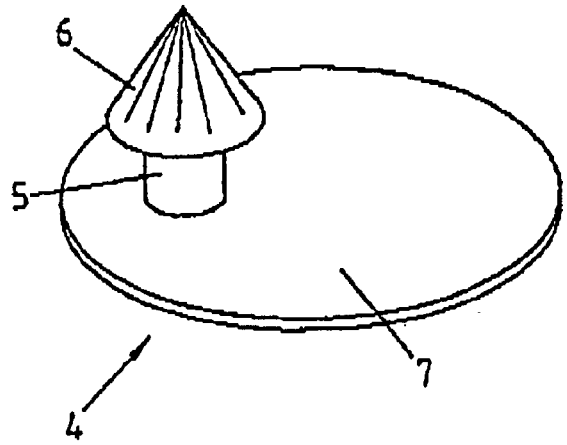
Figure 4B:
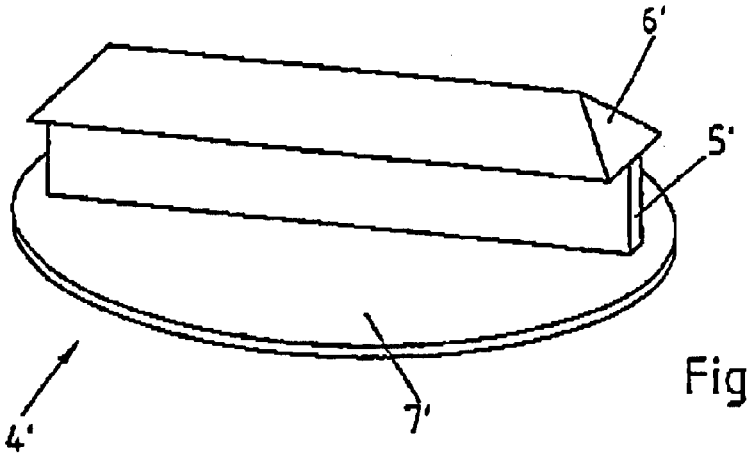

FIG. 4A shows a first configuration of an opening element 4 with a pin-shaped connecting element 5 molded onto the plate 7 as a single piece. The pin-shaped connecting element 5 has a conical incoming end 6, whose lower diameter is greater than the diameter of the pin-shaped connecting element 5, thereby performing the function of a barb, FIG. 4B shows another configuration of an opening element 4' with a web-shaped connecting element 5' molded onto the plate 7' in a single piece. The web-shaped connecting element 5' has one end 6' whose cross section is shaped like a barb.

Figure 4C:
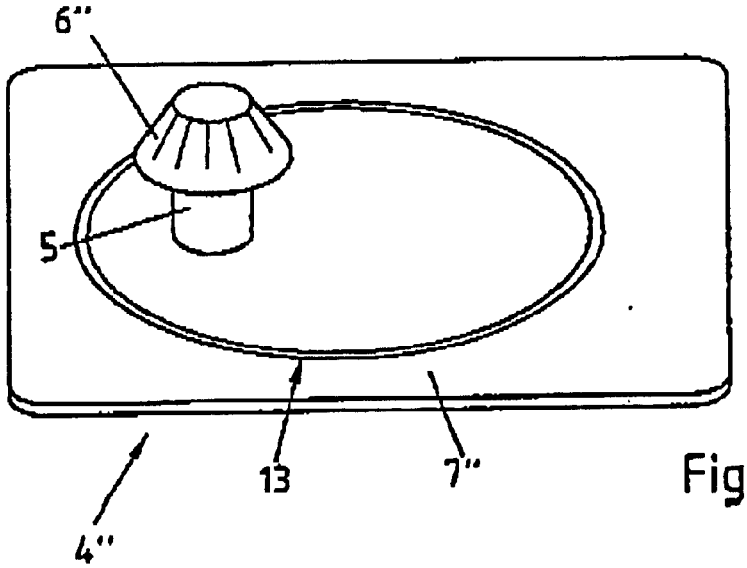

FIG. 4C shows an opening element 14 according to a third configuration of the invention, in which a plate 7" designed as a sealing element 4" has a weakening line 13 with the contour of the casting opening. Molded onto the plate 7" is a pin-shaped connecting element 5, which has a conical incoming end 6", whose lower diameter is greater than the diameter of the pin-shaped connecting element 5, thereby performing the function of a barb.

Figure 5:
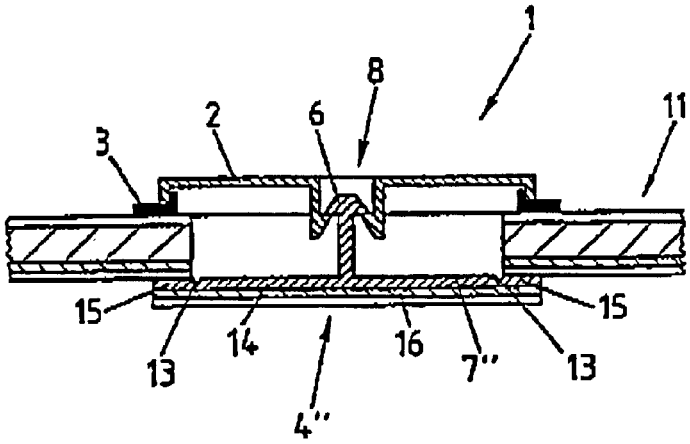

Keeping the same reference numbers from FIG. 1 for identical elements, FIG. 5 additionally shows an opening element 14 with a plate 7" designed as a sealing element 4" with a weakening line 13, which has the contour of the casting opening. The plate 7" has a larger cross section than the casting opening, so that it overlaps the areas of the composite that envelop the casting opening. On the product side, the sealing element 4" is provided with a gas or aroma barrier layer 16. When the spout element 1 is opened, the opening element 14 is broken out of the sealing element 4" along the perforated line 13, and pulled out of the packing, while the remaining portion of the sealing element 13 remains behind as a ring enveloping the casting opening.

What is claimed is:

1. A flat gable composite packing comprising:

at least one carrier layer made out of paper or cardboard;

a coupling agent layer;

an oxygen barrier layer;

an inner and an outer plastic coating made out of polyethylene;

a coated casting opening forming a casting hole after penetration, wherein said casting opening defines a contour; and a resealable spout element, wherein the resealable spout element comprises a flange and a cap connected thereto, said flange enveloping the coated casting opening and being rigidly bonded to the exterior of the flat gable composite packing, wherein an opening or sealing element attached to the interior of the flat gable composite packing is bonded with the cap via a connecting element penetrating the coated casting opening, said opening element and said cap forming an undetachable unit.

2. The flat gable composite packing of claim 1 comprising a square lug packing.

3. The flat gable composite packing of claim 1, wherein the oxygen barrier layer is made out of aluminium.

4. The flat gable composite packing of claim 1, wherein the opening element defines a contour corresponding essentially to the contour of the casting opening.

5. The flat gable composite packing of claim 1, wherein the opening element is sharp-edged on its edges pointing towards the inner plastic coating of polyethylene.

6. The flat gable composite packing of claim 1, wherein the opening element or sealing element comprises a plate attached flat to the interior of the flat gable composite packing.

7. The flat gable composite packing of claim 1, wherein the connecting element is moulded as a single piece onto the opening element.

8. The flat gable composite packing of claim 1, wherein the cap comprises a recess to receive one end of the connecting element, said end facing the cap.

9. The flat gable composite packing of claim 8, wherein the recess is located nearer to where the cap actuates than to where the cap is hinged to the flange.

10. The flat gable composite packing of claim 1, wherein the connecting element is moulded as single piece onto the cap.

11. The flat gable composite packing of claim 1, wherein this connecting element comprises a pin.

12. The flat gable composite packing of claim 1, wherein this connecting element comprises a web.

13. The flat gable composite packing of claim 1, wherein the connecting element comprises a cross section designed as a barb for a form-fitting connection of the opening element with the cap.

14. The flat gable composite packing of claim 1, wherein the connecting element is bonded with the cap via thermal treatment.

15. The flat gable composite packing of claim 1, wherein when the cap is sealed the connecting element is slit on its end facing the cap at least in a plane perpendicular to the sealed cap.

16. The flat gable composite packing of claim 1, further comprising a seal between the flange and the cap of the spout element, wherein said seal is broken when the cap is initially opened.

17. A method for manufacturing the flat gable composite packing of claim 1, said method comprising:

manufacturing the casting opening in the carrier layer;

coating the casting opening with films layer comprising an outer polyethylene layer, the oxygen layer and an inner polyethylene layer;

moulding on the packing floor;

puncturing with the connecting element the film layers covering the casting openings;

connecting the opening element with the inner polyethylene layer;

securing the spout element and connecting the cap with the opening element through the connecting element; and folding and sealing the flat gable composite packing after filling.

18. The method of claim 17, wherein the connecting element latches with the cap while applying the spout element.

19. The method of claim 17, wherein the connecting element is bonded with the cap via thermal deformation.

20. A method for manufacturing the flat gable composite packing of claim 1, said method comprising:

coating the carrier layer with the outer polyethylene layer, the oxygen layer and the inner polyethylene layer;

manufacturing the casting opening about the packing gable;

moulding on the packing floor;

securing the spout element and sealing element, and connecting the cap with the opening element through the connecting element; and folding and sealing the flat gable composite packing after filling.

21. The method of claim 20, wherein the connecting element latches with the cap while applying the spout element.

22. The method of claim 20, wherein the connecting element is bonded with the cap via thermal deformation.

23. A flat gable composite packing comprising:

at least one carrier layer made out of paper or cardboard;

a coupling agent layer;

an oxygen barrier layer;

an inner and an outer plastic coating made out of polyethylene;

a casting opening stamped out in the area of the flat gable composite packing, said casting opening defining a contour;

a resealable spout element, wherein the resealable spout element comprises a flange and a cap connected thereto, said flange enveloping the casting opening while being rigidly bonded to exterior of the flat gable packing, wherein an opening or sealing element attached to the interior of the flat gable packing is bonded with the cap through a connecting element in the area of the casting opening, said sealing element and said cap forming an undetachable unit, wherein the sealing element comprises a surface larger than the casting opening, a weakening line corresponding to the contour of the casting opening and bordering an opening element, said sealing element being provided with a gas or aroma barrier layer, and the opening element being separated from the sealing element upon opening of the spout element.

24. The flat gable composite packing of claim 23, comprising a square lug packing.

25. The flat gable composite packing of claim 23, wherein the oxygen barrier layer is made out of aluminium.

* * * * *